US006299664B1

(12) United States Patent
Matsumoto et al.

(10) Patent No.: US 6,299,664 B1
(45) Date of Patent: Oct. 9, 2001

(54) METHOD OF MANUFACTURING SLIDING PART AND VORTEX FLOW GENERATOR FOR INJECTION VALVE MANUFACTURED BY THAT METHOD

(75) Inventors: Osamu Matsumoto; Masayuki Aota; Mamoru Sumida, all of Tokyo; Tsuyoshi Munezane, Hyogo-ken; Takao Kasai; Takuro Kohyama, both of Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/161,677

(22) Filed: Sep. 29, 1998

(30) Foreign Application Priority Data

Feb. 4, 1998 (JP) ..... 10-023520

(51) Int. Cl.[7] ..... B22F 3/00; B22F 3/12
(52) U.S. Cl. ..... 75/246; 419/11; 419/37
(58) Field of Search ..... 419/37, 11, 54; 75/246

(56) References Cited

U.S. PATENT DOCUMENTS 3,849,877 * 11/1974 Fletcher et al. ..... 29/604
4,259,061 * 3/1981 Dubetsky ..... 432/13
4,886,637 * 12/1989 Jandeska, Jr. et al. ..... 419/12
5,624,631 * 4/1997 Luk ..... 419/23

FOREIGN PATENT DOCUMENTS 409 646 1/1991 (EP) .
2-215963 8/1990 (JP) .
4-254502 1/1993 (JP) .

* cited by examiner

*Primary Examiner*—Daniel J. Jenkins
(74) *Attorney, Agent, or Firm*—Sughrue, Mion, Zinn, Macpeak & Seas, PLLC

(57) ABSTRACT

A method of manufacturing a sliding part includes: an injection molding step of injection-molding a compacted member of a molding compound which is a mixture of powder material equivalent to SUS440C, graphite carbon corresponding to an oxygen content of the material, and a binder; a degreasing step of heating the compacted member thus obtained by the injection molding step under a neutral atmospheric condition to remove substantially all of the binder from the compacted member; and a baking step of heating the compacted member which is degreased under a vacuum condition of 0.1333 Pa or less from a room temperature up to 1000° C. to reduce an oxygen content of the compacted member to 0.02% or less by the reaction of C+O→CO, and then heating the compacted member under an argon atmospheric condition of 133.3 to 3999 Pa for two hours after the temperature is increased up to 1250° C.

9 Claims, 3 Drawing Sheets

METHOD OF MANUFACTURING SLIDING PART AND VORTEX FLOW GENERATOR FOR INJECTION VALVE MANUFACTURED BY THAT METHOD

BACKGROUND OF THE INVENTION

1. Field of the Invention

The present invention relates to a method of manufacturing a sliding part, and a vortex flow generator for an injection valve manufactured by that method.

2. Description of the Related Art

FIG. 2 is a sectional view showing a fuel injection valve 1 for injecting a fuel into a cylinder (hereafter referred to simply as the injection valve, when applicable), and FIG. 3A and FIG. 3B are a sectional view and a plane view, each showing a vortex member (a sliding part or a vortex flow generator) 13 incorporated in a valve device 3 of the injection valve 1.

As shown in FIG. 2, the injection valve 1 includes a housing main body 2, and the valve device 3 fixed to one end of the housing main body 2 by caulking or the like and covered by a sleeve 35. A fuel supply tube 4 is connected to the other end of the housing main body 2 so that a high pressure fuel is supplied from the fuel supply tube 4 through a fuel filter 37 to the injection valve 1.

The housing main body 2 includes a first housing 30 having a flange 30*a* through which the injection valve 1 is mounted onto a cylinder head (not shown) of an internal combustion engine, and a second housing 40 onto which a solenoid device 50 is mounted. The solenoid device 50 has a bobbin 52 on which a coil 51 is wound, and a core 53 installed in an inner circumferential portion of the bobbin 52. A winding of the coil 51 is connected to a terminal 56. The core 53 is formed into such a hollow cylindrical shape so as to define a fuel passage therein. A spring 55 is provided in the hollow portion of the core 53 and compressed between an adjuster 54 and a needle valve 12. An armature 31 is attached integrally to the other end of the needle valve 12 to confront with the leading end of the core 53. The intermediate portion of the needle valve 12 is formed to have a guide 12*a* for slidingly guiding the valve 12 along the inner circumferential surface of a valve main body 9, and a needle flange 12*b* contacted with a spacer 32 installed in the first housing 30. The housing main body 2 and the sleeve 35 cooperatively constitute a housing of the injection valve 1.

The first housing 30, the core 53 and the armature 31 are made of magnetic material, such as an electromagnetic stainless, to form a magnetic circuit.

The valve device 3 includes the valve main body 9, a valve seat 11, the needle valve 12 and the vortex member 13. The valve main body 9 is formed into a stepped hollow cylindrical shape, which has a central hole 9*a* axially-slidably and concentrically supporting the needle valve 12 while circumscribing the guide 12*a* of the same, and an accommodation hole 9*b* formed by enlarging the diameter of the leading end side of the central hole 9*a* for accommodating the valve seat 11 and the vortex member 13 therein. The valve seat 11 has a fuel injection hole 1 at its center, and is fixedly provided within the accommodation hole 9*b* of the valve body 9. The needle valve 12 is brought into and out of contact with the valve seat 11 by the solenoid device 50 to close and open a fuel injection hole 10. The vortex member 13 serves as the sliding member for guiding the needle valve 12 in an axial direction, and applying a vortex motion to the fuel before the fuel flows into the fuel injection hole 10 of the valve seat 11 radially inwardly.

A structure of the vortex member 13 will be described in detail with reference to FIGS. 3A and 3B.

The vortex member 13 is substantially in the form of a hollow cylindrical shape, which has a central hole 15 concentrically and axially-slidably supporting the needle valve 12 while surrounding the same. The vortex member 13 has a first end face 16 to be contacted with the valve seat 11, a second end face 17 opposite from the valve seat 11, and a periphery 18 contacted with the inner circumferential surface of the accommodation hole 9*b* of the valve main body 9, when assembled into the valve device 3.

The second end face 17 of the vortex member 13 is contacted with and supported by a stepped portion 9*c* of the accommodation hole 9*b* of the valve main body 9, is formed with passage grooves 17*a* each extended radially to allow the fuel to flow from the inner circumferential portion of the second end face 17 to the outer circumferential portion thereof. The periphery 18 of the vortex member 13 is formed with a large number of planar surfaces, which are provided at constant angular intervals in the circumferential direction and extends in the axial direction. More specifically, the periphery 18 is formed with a plurality of outer peripheral portions 18*a* in contact with the inner circumferential portion of the accommodation hole 9*b* of the valve main body 9 for regulating the relative position of the vortex member 13 to with respect to the valve main body 9, and flow passage portions 18*b* each of which is in the form of a planar surface located between adjacent two outer peripheral portions 18*a* and defines an axial flow passage for the fuel in cooperation with the inner circumferential surface of the accommodation hole 9*b*. Provided in the first end face 16 of the vortex member 13 are an inner circumferential annular groove 16*a*, which has a predetermined width and is formed in the inner circumferential portion adjacent to the central hole 15, and vortex grooves 16*b* each of which extends substantially radially inwardly so that one end thereof is connected to the flow passage portion 18*b* of the periphery 18 whereas the other end thereof is connected to the inner circumferential annular groove 16*a* in a tangential direction.

This valve device 3 is assembled as follows: The vortex member 13 is inserted into the accommodation hole 9*b* through one end of the valve main body 9, then the valve seat 11 is pressure-inserted into the accommodation hole 9*b* through the one end of the valve main body 9 and thereafter the valve main body 9 and the valve seat 11 are welded together for integration in an airtight manner. Further, the needle valve 12 is inserted into the central hole 9*b* through the other end of the valve main body 9 so that the leading end of the needle valve 12 is inserted into the central hole 15.

In the valve device 3, the needle valve 12 is reciprocally moved in the axial direction by the action of the solenoid device 50 such that the guide 12*a* is slide along the inner circumferential surface of the central hole 9*a* of the valve main body 9 and the leading end side of the needle valve 12 is slide along the inner circumferential surface of the central hole 15. The fuel injection hole 10 is closed when the leading end of the needle valve 12 is seated on the valve seat 11. During the opening of the fuel injection hole 10, the fuel passes through the passage grooves 17*a* to flow between the inner circumferential surface of the accommodation hole 9*b* and the flow passage portions 18*b*, and then passes through the vortex grooves 16*b* to flow into the inner circumferential annular grooves 16*a* in the tangential directions, thereby forming the vortex flow entering into the fuel injection hole 10 and dispersed from the leading end outlet thereof.

The injection valve 1 thus constructed is mounted in such a manner than the leading end thereof is inserted into an injection valve insertion hole (not shown) provided in the cylinder head, a depressing metal is applied to the flange 30 downwardly, and the depressing metal is fixedly tightened to the cylinder head with mounting bolts (not shown). Here, a planar washer or a corrugated washer is interposed between the injection valve 1 and the cylinder head, and the axial depressing force by the depressing metal ensures the sealing between the injection valve 1 and the cylinder head. In addition, the fuel supply tube 4 is fixed such that its attaching hole is engaged with an O-ring portion for sealing the upper portion of the injection valve 1.

By the control for the energization of the coil 51, the needle valve 12 is moved axially to open and close the fuel injection hole 10.

When the fuel injection hole 10 is opened, the fuel is supplied from the fuel supply tube 4, allowed to pass through the fuel passage inside the core 53, given vortex energy with the aid of the vortex member 13, and then dispersed from the fuel injection hole 10 into a combustion chamber.

This vortex member 13 is complicated in configuration. The grooves, which give or apply the vortex energy to the fuel, require extremely high accuracy in order to suppress variations in fuel injection quantity and dispersed configuration as small as possible. Further, anti-friction property is required for the central hole 15. For these reasons, the vortex member 13 must be manufactured with high dimensional accuracy from material having anti-friction property and high hardness, such as SUS440C. In general, the vortex member 13 is manufactured by machining (cutting), metal injection molding, sintering, cold forging or the like.

Manufacturing the vortex member 13 by the machining makes it easy to attain the required high dimensional accuracy, but difficult to cope with the complicated configuration, and results in the increased cost to manufacture.

Manufacturing the vortex member 13 by sintering or cold forging makes it easy to attain the complicated configuration but difficult to attain the high dimensional accuracy.

For these reasons, an attempt has been made to manufacture the vortex member 13 by metal injection molding which is advantageous over the machining in cost and applicability of the complicated configuration and by which high dimensional accuracy is available in contrast to the sintering and the cold forging.

However, iron-base alloys containing Cr of 10–20% and C of 0.5% or more such as SUS440C, which are superior in anti-friction and anti-corrosion properties, have liquid-phase line around 1260° C., and thus the upper limit of baking temperature is predetermined. Further, face-centered cubic phase appears in a range from 800° C. to the liquid-phase line, and thus sintering is hard to develop. Accordingly, the high dimensional accuracy cannot be attained by a conventional powder metallurgy in which a partially-low-density compacted member is baked.

Further, variation in carbon content of the baked member is large in case of a conventional baking process which does not accompany ambient adjustment, and it is not rare that carburizing process is required to adjust the carbon content to a desired value. Consequently, variation in hardness after thermal processing is unavoidable.

Therefore, a manufacturing method used in the conventional metal powder metallurgy encounters the difficult in processing SUS440C to provide high dimensional accuracy, high hardness and low porosity.

SUMMARY OF THE INVENTION

The present invention was made in order to solve the above-noted problems, and an object of the present invention is to provide a method of manufacturing a sliding part, which can realize high dimensional accuracy, high hardness and low porosity of a molded product by metal injection molding of raw material equivalent to SUS440C. Another object of the present invention is to provide a vortex flow generator for an injection valve, which is manufactured by that method.

In order to achieve the above object, according to one aspect of the present invention, there is provided a method of manufacturing a sliding part, characterized by comprising: an injection molding step of injection-molding a compacted member of a molding compound which is a mixture of powder material equivalent to SUS440C, graphite carbon corresponding to an oxygen content of the material, and a binder; a degreasing step of heating the compacted member thus obtained by the injection molding step under a neutral atmospheric condition to remove substantially all of the binder from the compacted member; and a baking step of heating the compacted member which is degreased under a vacuum condition of 0.1333 Pa or less from a room temperature up to 1000° C. to reduce an oxygen content of the compacted member to 0.02% or less by the reaction of $C+O \rightarrow CO$, and then heating the compacted member under an argon atmospheric condition of 133.3 to 3999 Pa for two hours after the temperature is increased up to 1250° C.

According to another aspect of the present invention, there is provided a vortex flow generator of an injection valve, which is manufactured by a manufacturing method comprising: an injection molding step of injection-molding a compacted member of a molding compound which is a mixture of powder material equivalent to SUS440C, graphite carbon corresponding to an oxygen content of the material, and a binder; a degreasing step of heating the compacted member thus obtained by the injection molding step under a neutral atmospheric condition to remove substantially all of the binder from the compacted member; and a baking step of heating the compacted member which is degreased under a vacuum condition of 0.1333 Pa or less from a room temperature up to 1000° C. to reduce an oxygen content of the compacted member to 0.02% or less by the reaction of $C+O \rightarrow CO$, and then heating the compacted member under an argon atmospheric condition of 133.3 to 3999 Pa for two hours after the temperature is increased up to 1250° C.

DETAILED DESCRIPTION OF THE PREFERRED EMBODIMENTS

Preferred embodiments of the present invention will now be described with reference to the accompanying drawings.

First embodiment

In a first embodiment, a vortex member 13, which is a sliding part to be incorporated in a valve device in an injection valve for injecting a fuel into a cylinder, is manufactured by metal injection molding using raw material powder equivalent to SUS440C. The vortex member 13 serves as a vortex flow generator.

Figure 1:
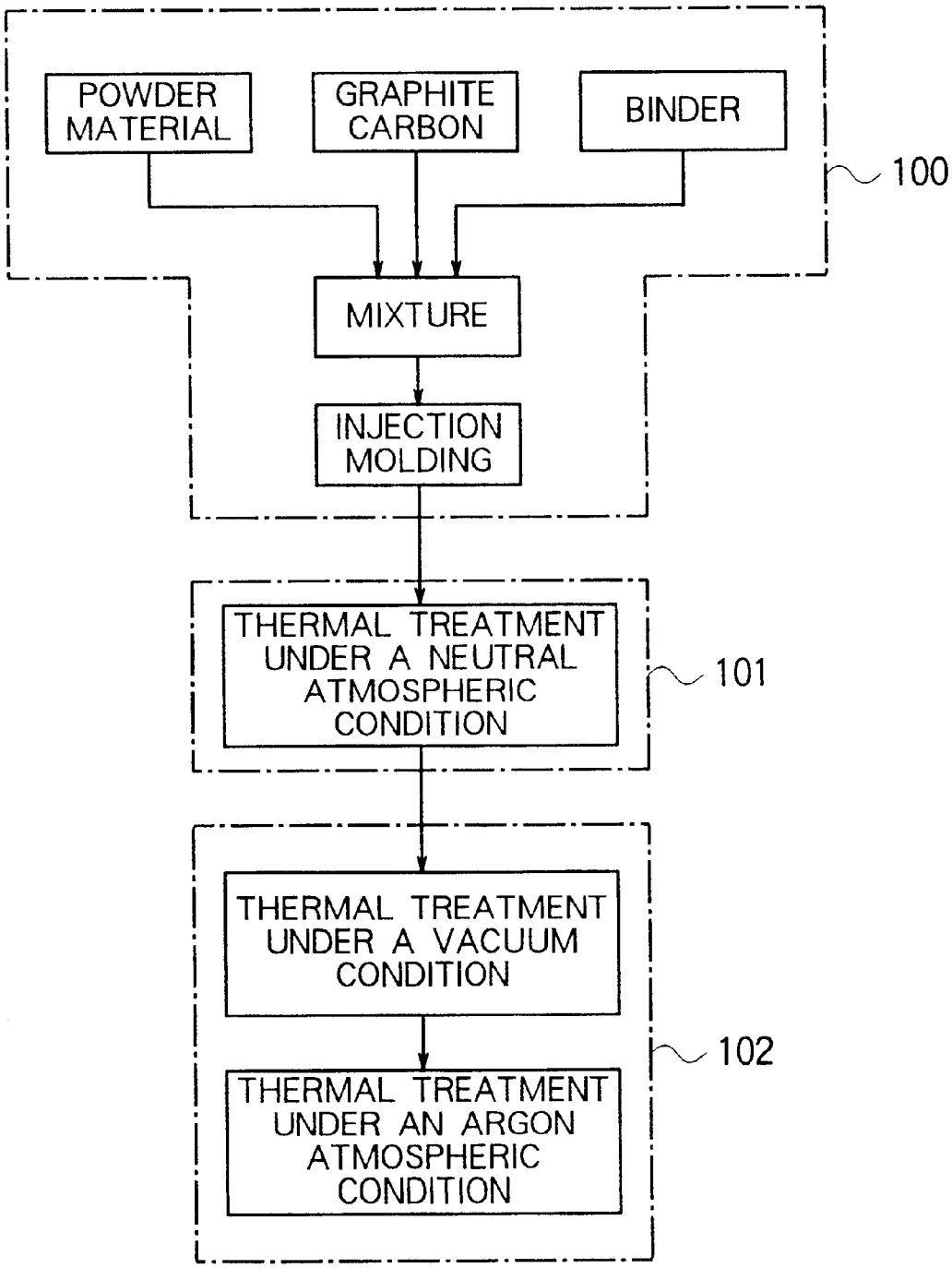
FIG. 1 is a flowchart showing a method of manufacturing a sliding part according to a first embodiment of the present invention.
Figure 2:
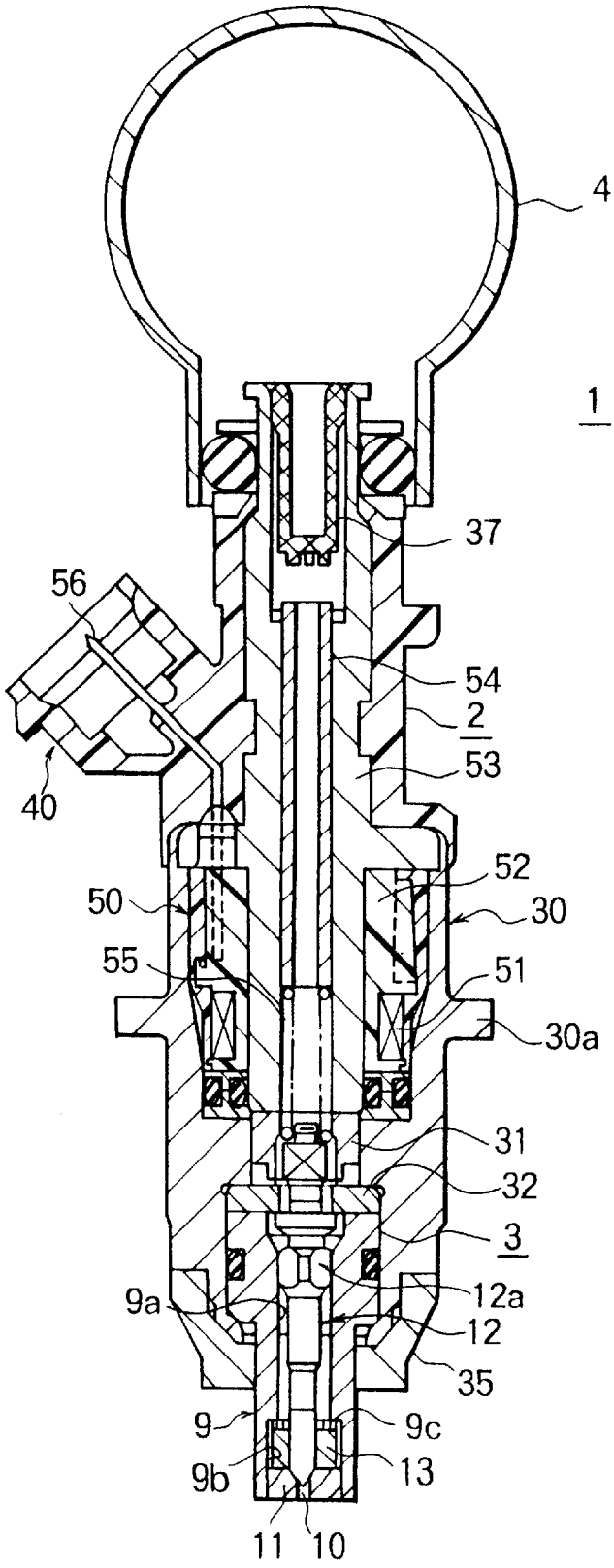
FIG. 2 is a sectional view showing an injection valve for injecting a fuel into a cylinder.

A method of manufacturing the vortex member 13 will be described with reference to FIG. 1.

The raw material powder equivalent to SUS440c, graphite carbon and binder are mixed together to provide a molding compound, which is metal-injection-molded into a compacted member of the vortex member 13 (an injection molding step 100). In this step, the graphite carbon is mixed at a corresponding amount to the oxygen content in the raw material powder. The binder is a mixture of high molecular component such as ethylenevinylacetic copolymer (EVA), polystyrene (PS), and polypropylene (PP) and low molecular component such as wax, stearic acid, and dibutyl phthalate (DBP), where the high molecular component is contained at a ratio of 50–70% by weight and the low molecular component is contained at a ratio of 30–50% by weight.

The compacted member thus obtained by this injection molding step 100 is placed on a baking setter of 99.9% or more alumina material, and set within a baking furnace. The air within the furnace is discharged to provide a vacuum condition of $10^{-3}$ Torr (0.1333 Pa) or less, and then nitrogen gas or argon gas is introduced into the furnace to provide a vacuum condition of about $10^{-2}$ Torr (1.333 Pa) so that neutral atmosphere is created inside the furnace, and thereafter the compacted member is subjected to a thermal treatment for 45 hours from a room temperature to 450° C. (a degreasing step 101). This degreasing step 101 removes almost all binder from the compacted member.

Subsequently to the degreasing step 101, the air within the furnace is discharged to provide a vacuum condition of $10^{-3}$ Torr (0.1333 Pa) or less, and after the temperature within the furnace is increased from the room temperature to 800° C., the compacted member is subjected to a thermal treatment for one hour or more from 800° C. to 1000° C. (a deoxidation step). This thermal treatment removes oxygen from the compacted material through the reaction of C+O→CO, so that the oxygen content of the compacted member is reduced to 0.02% or less. Then, after argon gas is introduced into the furnace to provide argon atmosphere of 1–30 Torr (133.3–3999 Pa), the temperature is increased up to 1250° C., and the compacted material is subjected to a thermal treatment for two hours under that condition (a sintering step 102). After the sintering step 102 is completed, the compacted member is cooled to the room temperature, and the vortex member 13 is obtained.

The vortex member 13 manufactured in this manner possessed the hardness of HRc 50 or more after subjected to treatments of "sub-zero" quenching and tempering, which satisfactorily met the anti-fiction property required as the sliding part. Further, the high density of 97% or more was obtained to meet the low porosity requirement, and the high dimensional accuracy was also attained. In other words, in the vortex member 13 the groove configurations of the vortex grooves 16, etc. were formed with high accuracy. An injection valve, in which this vortex member 13 was assembled into the valve device, exhibited superior characteristics, i.e. less variation in fuel injection quantity and dispersed configuration, more durability and improved anti-corrosion property.

Since the vortex member 13 is made of SUS440C, the vortex member 13 can bear against a severe use condition of the injection valve where it is supplied with high pressure fuel of 1 MPa or more, and exposed to heat of the cylinder and high temperature and high pressure of combustion gas in the combustion chamber.

In this first embodiment, since the graphite carbon is added to the raw material powder at the amount corresponding to the oxygen content of the raw material to provide the molding compound, the loss of the carbon from the raw material by the reaction of C+O→CO in the thermal treatment under vacuum condition during the baking step 102 can be supplemented by the added graphite carbon, so that the composition change of the raw material can be suppressed. Therefore, the composition of SUS440C is held in the vortex member 13 obtained by baking, thereby maintaining the anti-friction property in the vortex member 13, enhancing the quenching property, attaining the high hardness, and contributing to the high dimensional accuracy.

Therefore, according to the first embodiment, there is provided the method of manufacturing the vortex member by the metal injection molding using material equivalent to SUS440C which can realize the required high dimensional accuracy, high hardness and low porosity.

The use of the metal injection molding makes it possible to manufacture the vortex member 13 inexpensively.

Since the degreased, compacted member is placed on the baking setter made of alumina material of 99.9% or more in the baking step 102, the separation ability of the vortex member 13 obtained by baking from the setter is excellent, which reduces the possible cracking and chipping of the vortex member 13 during removal to enhance yield or productivity thereof. Since the setter is made of high purity alumina material, the impurity is not dispersed to the compacted member from the setter during baking, and therefore the change in composition of the vortex member 13 can be suppressed.

Since the vortex member 13 is manufacture by metal injection molding of material equivalent to the SUS440C, the extremely excellent anti-corrosion property can be obtain in comparison to a conventional vortex member manufactured by metal injection molding of SKD11.

Since the binder as the mixture of the high molecular component and the low molecular component is used, the binder can avoid deformation of the compacted member during the degreasing step 101 carried out before baking. That is to say, during the process of thermally decomposition of the binder, although the low molecular component is decomposed and released from the compacted material at a lower temperature than the high molecular component, the high molecular component remains as a part of body of the compacted member even in high temperatures to prevent the deformation thereof. In a high temperature range in which the high molecular component is decomposed, the low temperature component has already disappeared in the compacted member, and the quantity of the binder, which causes the deformation of the compacted member, has been reduced, and therefore the binder-less body free from the deformation can be obtained.

If the quantity of the high molecular component is less than 50% of the entire weight, then the deformation preventive effect is small. If the quantity of the high molecular component exceeds 70%, then the flowability of the compound during the molding process is lowered so that the strain-less compacted member cannot be obtained. For these reasons, it is preferable to set the ratio of the high molecular component in the range of 50–70% by weight.

During the degreasing step 101, the air within the furnace is discharged to provide a vacuum condition of $10^{-3}$ Torr (0.1333 Pa) or less, and then nitrogen gas or argon gas is introduced into the furnace to provide a vacuum condition of about $10^{-2}$ Torr (1.333 Pa) so that neutral atmosphere is created inside the furnace. However, it is not essential to provide a vacuum condition of about $10^{-2}$ Torr (1.333 Pa) within the furnace as far as the neutral atmospheric condition is created inside the furnace to suppress the change in oxygen amount of the compacted member. For example, the atmospheric pressure condition is also applicable.

During the degreasing step 101, the compacted member is subjected to the thermal treatment for 45 hours from a room temperature to 450° C. Processing time period of 45 hours or more is preferable since the compacted member may expand if the processing time period is less than 45 hours. Although the processing temperature depends on the selected high molecular component, it is preferable to set 450° C. or less if the ethylenevinylacetic copolymer is selected.

During the deoxidation step in the baking step 102, the vacuum condition of $10^{-3}$ Torr (0.1333 Pa) or less is provided, and then the compacted member is subjected to the thermal treatment for one hour or more from 800° C. to 1000° C. If the processing time period is less than one hour, then the oxygen content is not sufficiently lowered, and thus the processing time period of one hour or more is preferable.

Figure 3A:
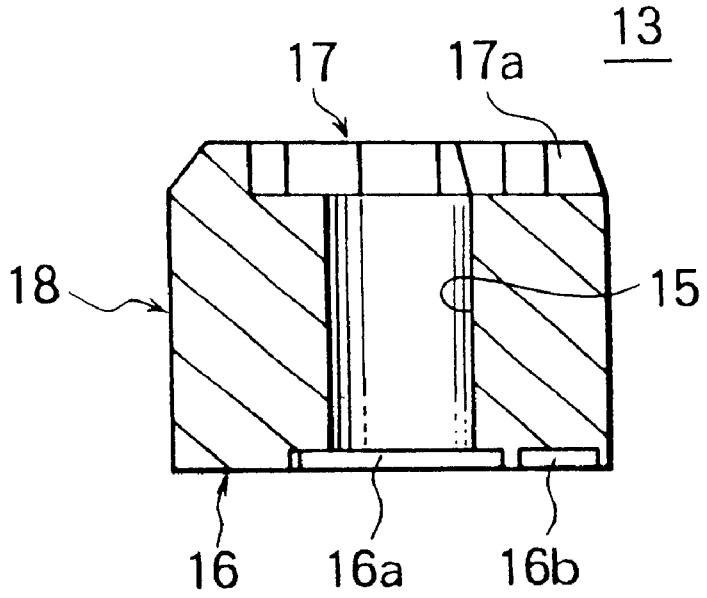
FIG. 3A is a sectional view showing a vortex member to be incorporated into a valve device in the injection valve for injecting a fuel into a cylinder.
Figure 3B:
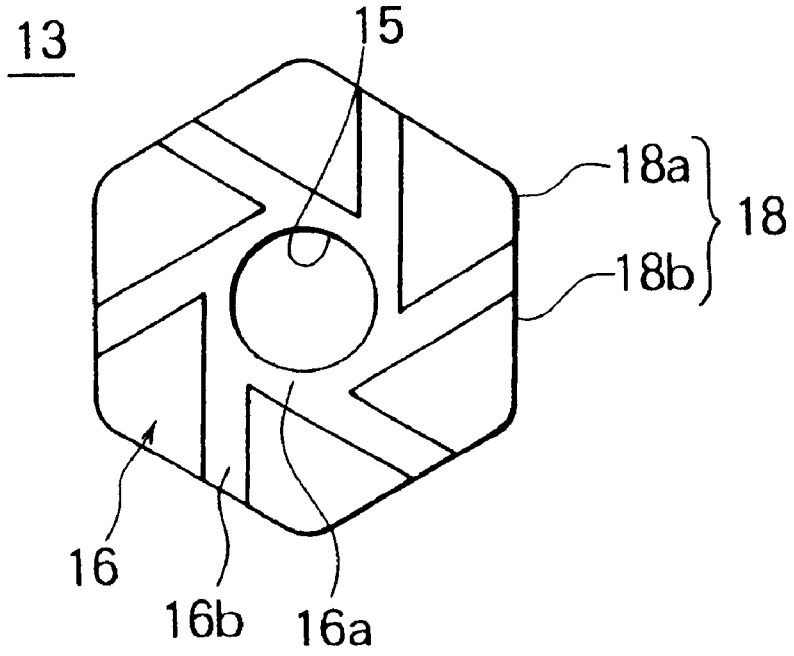
FIG. 3B is a plane view showing the vortex member to be incorporated into the valve device in the injection valve for injecting a fuel into a cylinder.

In the above-described first embodiment, the description is made on a case where the vortex member 13 obtained by baking the compacted member obtained by metal injection molding is installed into the valve device. If the accuracy is particularly required, then the vortex member 13 obtained by baking may be subjected to a finishing process in which inner and outer diameter porions and both end faces are ground. A vortex member 13 manufactured by the present method should not be restricted to the vortex member 13 shown in FIG. 3. For example, the configuration and the number of the grooves for generating vortex flow may be modified appropriately. Furthermore, it is also applicable to the vortex member whose holes in place of the vortex grooves may be applied to the vortex member to generate the vortex flow.

In the above-described first embodiment, the description is made on a case where the vortex member to be incorporated into the valve device of the injection valve for injecting the fuel into the cylinder as a sliding part is manufactured, but the invention can also be applied to a case where the vortex member to be incorporated in a valve device of a general fuel injection valve is manufactured.

Further, the present invention can be applied to, particularly, sliding parts that control various kinds of fuel for internal combustion engines. For example, the invention can be applied to sliding parts in fuel injection valves adapted to gasoline and diesel engines.

Still further, according to the present invention, the sliding part manufactured by the present method should not be restricted to the vortex member, and the invention can be also applied to any sliding part having a complicated configuration and requiring high dimensional accuracy and anti-friction property. For example, the present invention can be also applied to a valve main body, a needle valve or the like.

In the above-described first embodiment, as the high molecular component of the binder, ethylenevinylacetic copolymer (EVA), polystyrene (PS), and polypropylene (PP) are listed, and as the low molecular component of the binder, wax, stearic acid, and dibutyl phthalate (DBP) are listed. One material may be selected from these listed materials, or two or more materials may be combined for each of the high and low molecular components.

The present invention constructed in the above-noted manner can provides the following effects:

A method of manufacturing a sliding part according to the present invention comprises: an injection molding step of injection-molding a compacted member of a molding compound which is a mixture of powder material equivalent to SUS440C, graphite carbon corresponding to an oxygen content of the material, and a binder; a degreasing step of heating the compacted member thus obtained by the injection molding step under a neutral atmospheric condition to remove substantially all of the binder from the compacted member; and a baking step of heating the compacted member under a vacuum condition of 0.1333 Pa or less from a room temperature up to 1000° C. to reduce an oxygen content of the compacted member to 0.02% or less by the reaction of $C+O \rightarrow CO$, and then heating the compacted member under an argon atmospheric condition of 133.3 to 3999 Pa for two hours after the temperature is increased up to 1250° C. Therefore, it is possible to provide the method of manufacturing the sliding part which can realize high dimensional accuracy, high hardness and low porosity inexpensively by the metal injection molding of the material equivalent to SUS440C.

The above binder of molding compound essentially consists of a high molecular component of 50–70% by weight and a low molecular component of 30–50% by weight. Therefore,the deformation of the compacted member during the degreasing step can be suppressed.

A baking setter made of 99.5% or more alumina material is used as a setter on which the compacted member thud degreased is placed during the above baking step. Therefore, cracking and chipping which may occur during removal of the compacted member can be suppressed, thereby enhancing the yield or productivity.

The above sliding part is one of sliding parts which controls a various kind of fuel for internal combustion engines. Therefore, it is possible to meet the required high accuracy and anti-friction property, and to control high pressure fuel accurately for a long life time.

The above sliding part is a sliding part of a fuel injection valve for injecting a gasoline into a cylinder of an engine. Therefore, it is possible to adapt the sliding part in the severe use condition of high temperature and high pressure.

The sliding part is a vortex flow generator for generating a vortex flow of the fuel. Therefore, variations in fuel injection amount and sprayed fuel configuration can be suppressed.

A vortex flow generator of an injection valve according to the present invention is manufactured by a manufacturing method comprising: an injection molding step of injection-molding a compacted member of a molding compound which is a mixture of powder material equivalent to SUS440C, graphite carbon corresponding to an oxygen content of the material, and a binder; a degreasing step of heating the compacted member thus obtained by the injection molding step under a neutral atmospheric condition to remove substantially all of the binder from the compacted member; and a baking step of heating the compacted member under a vacuum condition of 1333 Pa or less from a room temperature up to 1000° C. to reduce an oxygen content of the compacted member to 0.02% or less by the reaction of $C+O \rightarrow CO$, and then heating the compacted member under an argon atmospheric condition of 133.3 to 3999 Pa for two hours after the temperature is increased up to 1250° C. Therefore, it is possible to provide the vortex flow generator of the injection valve, which is high in dimensional accuracy, excellent in anti-friction and anti corrosion properties, inexpensively.

The above binder of molding compound essentially consists of a high molecular component of 50–70% by weight and a low molecular component of 30–50% by weight. Therefore, the deformation of the compacted member during the decreasing step can be suppressed.

A baking setter made of 99.5% or more of alumina material is used as a setter on which the compacted member thus decreased is placed during the above baking step. Therefore, the vortex flow generator is free from cracking and chipping during the removal of the based material, thereby improving the yield or productivity of the generator and lowering cost.

What is claimed is:

1. A method of manufacturing a sliding part, comprising:

an injection molding step of injection-molding a compacted member of a molding compound which is a mixture of a powdered, iron-based alloy material containing 10–20% Cr and more than 0.5% C, graphite carbon corresponding to an oxygen content of said material, and a binder;

a degreasing step of heating said compacted member thus obtained by said injection molding step under a neutral atmospheric condition to remove substantially all of said binder from said compacted member; and a baking step of heating said compacted member under a vacuum condition of 0.1333 Pa or less from a room temperature up to 1000° C. to reduce an oxygen content of the compacted member to 0.02% or less by the reaction of $C+O \rightarrow CO$, and then heating said compacted member under an argon atmospheric condition of 133.3 to 3999 Pa for two hours after the temperature is increased up to 1250° C.

2. A method of manufacturing a sliding part according to claim 1, wherein said binder of said molding compound essentially consists of a high molecular component of 50–70% by weight and a low molecular component of 30–50% by weight.

3. A method of manufacturing a sliding part according to claim 1, wherein a baking setter made of 99.5% or more of alumina material is used as a baking setter on which said compacted member thus degreased is placed during said baking step.

4. A method of manufacturing a sliding part according to claim 1, wherein said sliding part is one of sliding parts that control a various kind of fuel for internal combustion engines.

5. A method of manufacturing a sliding part according to claim 4, wherein said sliding part is a sliding part of a fuel injection valve for injecting a gasoline into a cylinder of an engine.

6. A method of manufacturing a sliding part according to claim 5, wherein said sliding part is a vortex flow generator for generating a vortex flow of the fuel.

7. A vortex flow generator of an injection valve, which is manufactured by a manufacturing method comprising:

an injection molding step of injection-molding, a compacted member of a molding compound which is a mixture of a powdered, iron-based alloy material containing 10–20% Cr and more than 0.5% C, graphite carbon corresponding to an oxygen content of said material, and a binder;

a degreasing step of heating said compacted member thus obtained by said injection molding step under a neutral atmospheric condition to remove substantially all of said binder from said compacted member; and a baking step of heating said compacted member which is degreased under a vacuum condition of 0.1333 Pa or less from a room temperature up to 1000° C. to reduce an oxygen content of the compacted member to 0.02% or less by the reaction of $C+O \rightarrow CO$, and then heating said compacted member under an argon atmospheric condition of 133.3 to 3999 Pa for two hours after the temperature is increased up to 1250° C.

8. A vortex flow generator of an injection valve according to claim 7, wherein said binder of molding compound essentially consists of a high molecular component of 50–70% by weight and a low molecular component of 30–50% by weight.

9. A vortex flow generator of an injection valve according to claim 7, wherein a baking setter made of 99.5% or more of alumina material is used as a baking setter on which said compacted member thus degreased is placed during said baking step.

* * * * *

UNITED STATES PATENT AND TRADEMARK OFFICE

CERTIFICATE OF CORRECTION

PATENT NO. : 6,299,664 B1
APPLICATION NO. : 09/161677
DATED : October 9, 2001
INVENTOR(S) : Osamu Matsumoto et al.

It is certified that error appears in the above-identified patent and that said Letters Patent is hereby corrected as shown below:

On title page

Item (73), please change the Assignee from "Mitsubishi Denki Kabushiki Kaisha, Tokyo (JP)" to --Mitsubishi Denki Kabushiki Kaisha and Citizen Watch Co., Ltd., Tokyo (JP)--.

Signed and Sealed this

Twenty-second Day of May, 2007

JON W. DUDAS
*Director of the United States Patent and Trademark Office*